US009618198B2

(12) United States Patent
Lindstrom et al.

(10) Patent No.: US 9,618,198 B2
(45) Date of Patent: Apr. 11, 2017

(54) BURNER COMPRISING A REACTOR FOR CATALYTIC BURNING

(75) Inventors: Bard Lindstrom, Johanneshov (SE); Daniel Hagstrom, Stocksund (SE); Paula Beneyto Satorres, Solna (FR); Sara Marie Logdberg, Saltsjo-boo (SE)

(73) Assignee: REFORMTECH HEATING HOLDING AB, Kista (SE)

( * ) Notice: Subject to any disclaimer, the term of this patent is extended or adjusted under 35 U.S.C. 154(b) by 242 days.

(21) Appl. No.: 14/343,929

(22) PCT Filed: Sep. 10, 2012

(86) PCT No.: PCT/SE2012/050950

§ 371 (c)(1),
(2), (4) Date: Mar. 10, 2014

(87) PCT Pub. No.: WO2013/036198

PCT Pub. Date: Mar. 14, 2013

(65) Prior Publication Data

US 2014/0220501 A1 Aug. 7, 2014

(30) Foreign Application Priority Data

Sep. 8, 2011 (SE) ..... 1150808

(51) Int. Cl.
*F23D 14/78* (2006.01)
*F23C 5/32* (2006.01)
(Continued)

(52) U.S. Cl.
CPC ..... *F23C 5/32* (2013.01); *F23C 7/002* (2013.01); *F23C 7/04* (2013.01); *F23C 13/00* (2013.01);
(Continued)

(58) Field of Classification Search
CPC .. F23C 13/00; F23C 13/06; F23C 5/32; F23C 7/002
(Continued)

(56) References Cited

U.S. PATENT DOCUMENTS 3,641,953 A * 2/1972 Herzberg ..... F23M 5/00 110/323
5,228,847 A * 7/1993 Lywood ..... F23R 3/40 431/11
(Continued)

FOREIGN PATENT DOCUMENTS

CN 1204021 1/1999
CN 101839199 9/2010
(Continued)

OTHER PUBLICATIONS

International Search Report dated Dec. 20, 2012, corresponding to PCT/SE2012/050950.
(Continued)

*Primary Examiner* — Gregory Huson
*Assistant Examiner* — Nikhil Mashruwala
(74) *Attorney, Agent, or Firm* — Young & Thompson

(57) ABSTRACT

A burner includes a generally cylindrical reactor chamber (1) including a housing (1') having a proximal end (1*p*) and a distal end (1*d*). In the distal end of the reactor chamber (1) there is provided a catalyst (4). A fuel inlet (7) is provided in the proximal end of the reactor chamber. There are also a plurality of air inlets (22, 23; 24) arranged in the reactor wall at the proximal end. The inlets are configured to provide a rotating flow of the air injected into the reactor chamber. There is also provided a flow homogenizer (8; 30) extending over the cross-section of the reactor chamber at a position between the fuel inlet (7) and the catalyst (4).

20 Claims, 3 Drawing Sheets

Figure 1:
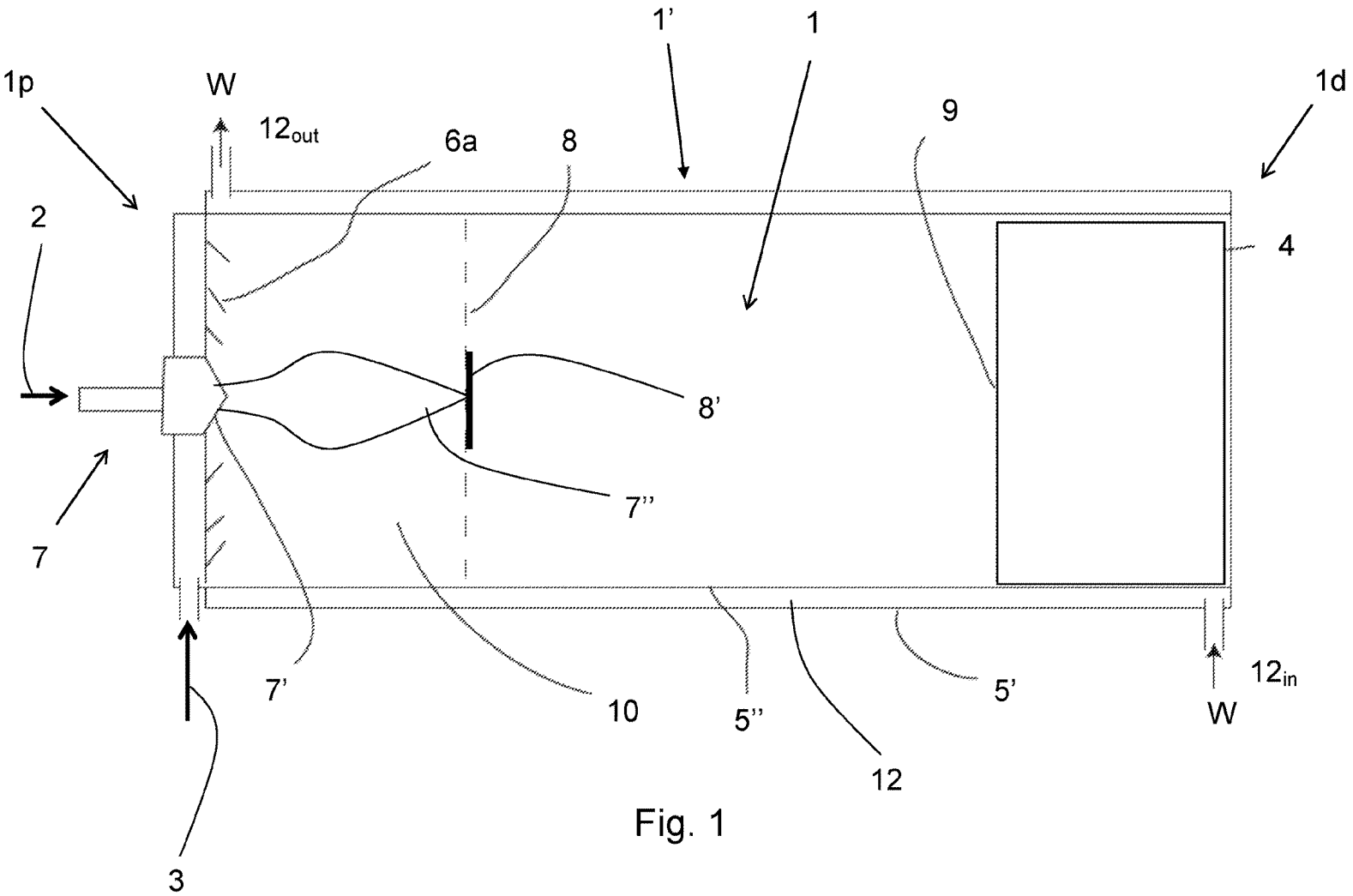

(51) Int. Cl.

| | |
|---|---|
| ***F23M 9/06*** | (2006.01) |
| ***F23C 7/00*** | (2006.01) |
| ***F23C 7/04*** | (2006.01) |
| ***F23C 13/06*** | (2006.01) |
| ***F23D 11/40*** | (2006.01) |
| ***F23C 13/00*** | (2006.01) |

(52) U.S. Cl.
CPC ..... *F23C 13/06* (2013.01); *F23D 11/402* (2013.01); *F23D 11/406* (2013.01); *F23D 14/78* (2013.01); *F23M 9/06* (2013.01); *F23D 2900/00016* (2013.01); *F23D 2900/11401* (2013.01); *F23D 2900/21002* (2013.01)

(58) Field of Classification Search
USPC ..... 431/160, 7, 170, 326; 60/39.11, 723, 60/39.12
See application file for complete search history.

(56) References Cited

U.S. PATENT DOCUMENTS

| | | | | |
|---|---|---|---|---|
| 5,461,864 | A | 10/1995 | Betta et al. | |
| 5,735,681 | A * | 4/1998 | Cheng | F23C 7/002 110/260 |
| 5,987,878 | A * | 11/1999 | Koyama | B01B 1/005 422/177 |
| 8,555,647 | B2 | 10/2013 | Dimascio et al. | |
| 8,596,074 | B2 | 12/2013 | Nilsson et al. | |
| 2003/0096204 | A1 * | 5/2003 | Hermann | F23C 13/00 431/7 |
| 2003/0188486 | A1 | 10/2003 | Tanaka et al. | |
| 2004/0206090 | A1 * | 10/2004 | Yee | F23C 13/00 60/777 |
| 2005/0044842 | A1 | 3/2005 | Dinu | |
| 2009/0320490 | A1 | 12/2009 | Nilsson et al. | |
| 2011/0061299 | A1 * | 3/2011 | Roychoudhury | B01F 3/04049 48/197 FM |

FOREIGN PATENT DOCUMENTS

| | | | |
|---|---|---|---|
| EP | 1843098 | | 10/2007 |
| EP | 2023040 | A1 | 2/2009 |
| GB | 588086 | A | 5/1947 |
| GB | 739699 | | 11/1955 |
| JP | 59225211 | | 12/1984 |
| JP | 61-181906 | U | 11/1986 |
| JP | 62-63530 | | 4/1987 |
| JP | 9-14617 | | 1/1997 |
| JP | 2001-50508 | | 2/2001 |
| JP | 2001-272007 | | 10/2001 |
| WO | 2006/138174 | | 12/2006 |

OTHER PUBLICATIONS

Extended European Search Report, dated Mar. 18, 2015, for corresponding patent application.
Chinese Office Action in corresponding Chinese Application No. 20128004379, dated Apr. 15, 2016.
Japanese Office Action in corresponding Japanese Application No. 2014-529642, dated May 24, 2016.
Chinese Office Action issued in Application No. 201280043797.2 dated Sep. 8, 2016.

* cited by examiner

BURNER COMPRISING A REACTOR FOR CATALYTIC BURNING

The present invention relates to a reactor system for optimizing the catalytic combustion of liquid fuels for automotive and stationary applications.

BACKGROUND OF THE INVENTION

In catalytic burners according to the prior art it is desirable that the catalyst is used in an optimal manner, i.e. that the gases flowing through the catalyst is as homogeneous as possible. If the fuel:air ratio is biased towards excess fuel so called "hot spots" can occur, which can cause damage to the catalyst.

Thus, thorough mixing of the fuel and air is required.

In the prior art it is known to mix air and fuel before passing the mixture into the reaction chamber where it is ignited. This is no problem if the reaction chamber is sufficiently long, because any inhomogeneity is levelled out over a sufficiently long distance. However, if the reactor is shortened in order to save space or to fit it into small compartments, this levelling out cannot be achieved.

SUMMARY OF THE INVENTION

In view of the above mentioned problems the inventors have devised a reactor with which a very good mixing is achieved, thereby alleviating the risks of damage to the catalyst caused by uneven combustion.

In a first aspect there is provided a novel burner comprising a reactor for catalytic burning wherein the mixing of fuel and air is improved. The burner is defined in claim 1, and comprises a generally cylindrical reactor chamber comprising a housing having a proximal end and a distal end; a catalyst provided in the distal end of the reactor chamber; a fuel inlet provided in the proximal end of the reactor chamber; a plurality of air inlets arranged in the reactor wall at the proximal end, and configured to provide a rotating flow of the air injected into the reactor chamber; a flow homogenizer extending over the cross-section of the reactor chamber at a position between the fuel inlet and the catalyst.

In a second aspect there is provided a method of catalytic burning of fuel with improved mixing of the fuel and air. The method is defined in claim 11.

Thus, the invention is based on two main features: 1) the provision of means to cause the air that is passed into the reactor to rotate inside the chamber, thereby causing turbulence that efficiently mixes the air with fuel; 2) the provision of a secondary mixer, in an exemplary embodiment in the form of a mesh that spans the cross-section of the reactor chamber at a distance from the inlet. This secondary mixer will break up the turbulent flow and cause an essentially complete homogenisation of the fuel/air mixture and also cause an essentially linear flow after the secondary mixer.

The advantage with complete homogeneous mixing and linear flow, which is created by the mixing system according to the invention can be summarized in four points:

1. It eliminates the formation of hotspots in the catalyst that could potentially lead to lower life times of the product
2. It ensures that the entire catalyst is utilized in the process, which results in optimization of catalyst size and materials that lowers operating costs of the catalytic heater
3. It optimizes the size of the catalytic reactor as the required residence time of the mixture to achieve linear and homogeneous flow is minimized by the forced flow stabilization in the reactor 4. The rotational motion of fuel/air mixture creates a central forward flow motion that prevents fuel from contacting the walls of the reactor, thereby preventing soot formation in the reactor.

Figure 2:
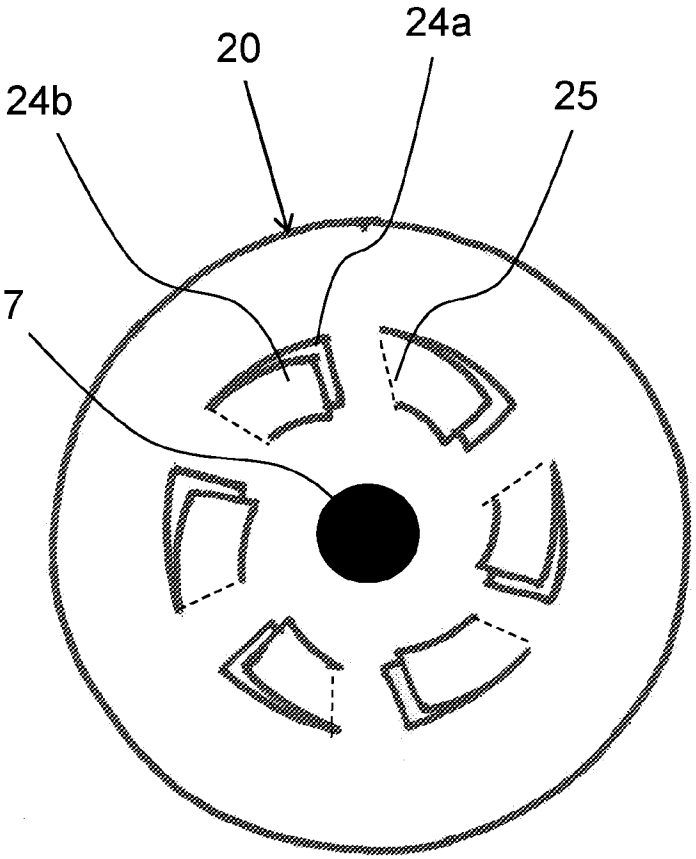
Figure 3B:
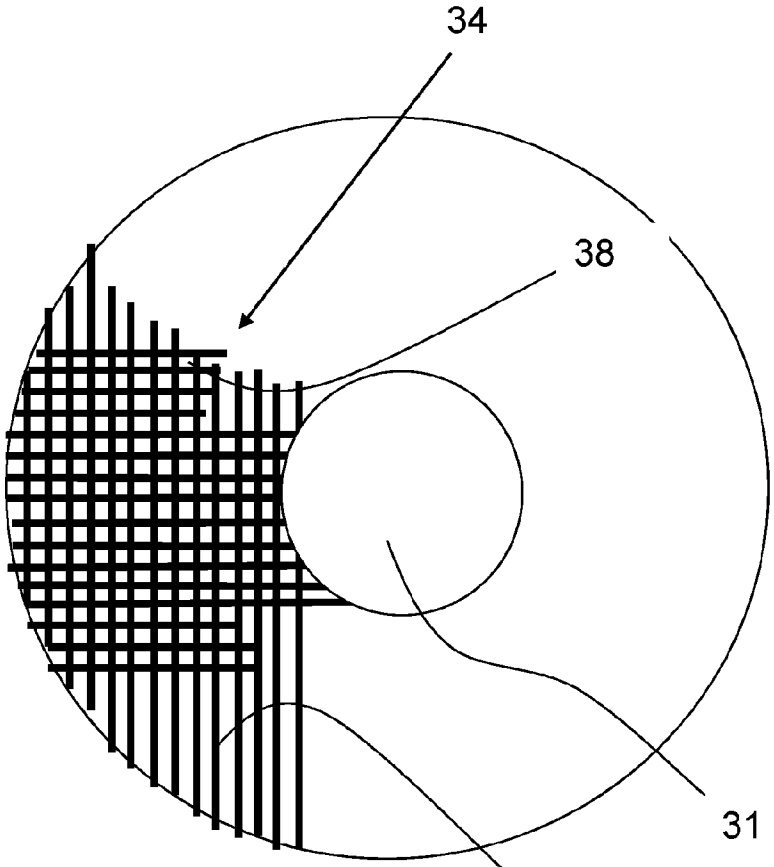
Figure 3A:
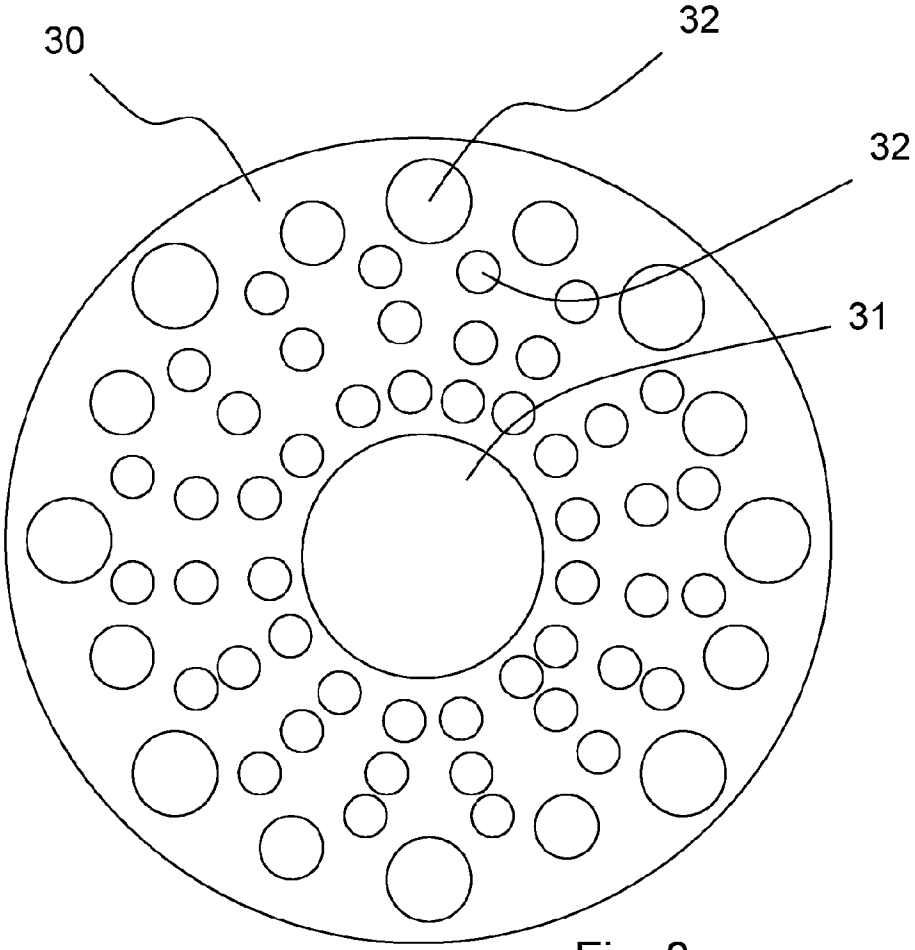

Further scope of applicability of the present invention will become apparent from the detailed description given hereinafter and the accompanying drawings which are given by way of illustration only, and thus not to be considered limiting on the present invention, and wherein FIG. 1 is a schematic cross-section through a burner;

FIG. 2 shows one embodiment of a distributor;

FIG. 3*a* illustrates a homogenizer; and

FIG. 3*b* shows another homogenizer.

DETAILED DESCRIPTION OF PREFERRED EMBODIMENTS

The novel catalytic reactor system, schematically shown in FIG. 1 comprises a generally cylindrical reactor, generally designated 1, and having a proximal and a distal end, designated 1*p* and 1*d*, respectively. Fuel 2 and air 3 are introduced separately in the reactor and then mixed to form a homogeneous mixture before contact is made with the catalyst 4. In a preferred embodiment the reactor system also comprises an internal cooling system 5', 5", 12 for reducing the formation of emissions from the catalytic reactor. A fuel injection means 7 comprising a nozzle 7' adapted to atomize the fuel before it is mixed with air and ignited to produce a flame 7" is provided in the reactor end wall in the proximal end 1*p*.

Essential features of the novel reactor system are means provided for mixing fuel and air in a very efficient manner, and for homogenizing the flow of mixed gas for the purpose of utilizing the catalyst as efficiently as possible.

In FIG. 1 the mixing means is schematically indicated at 6*a*, which represents openings provided circumferentially around the fuel atomizing nozzle 7'. The geometry of these openings can vary within wide limits as will be explained further below in connection with FIG. 2. The important functional feature of the mixing means 6*a* is that it be capable of setting the air in rotation inside the cylindrical reactor chamber.

By virtue of the vigorous rotation of the air along the inner walls of the cylindrical reactor chamber there will be a very efficient mixing of fuel, air and combustion gases produced in the flame.

This vigorous mixing causes extremely turbulent flow inside the reactor, and in particular the rotating air will provide a "blanket" of air closest to the reactor wall. The blanket protects the walls from the flame, in that soot formation is effectively hindered or even prevented to occur on the reactor walls.

Another effect of the vigorous mixing is that the turbulent flow of gases that is caused thereby, will exhibit an inhomogeneous concentration of fuel in the fuel/air mixture. This in turn may cause hotspots in the catalyst which can cause premature degeneration of the catalyst, and thus shorter life times.

In order to homogenize the flow and to transform the turbulent rotation to an essentially linear flow, and thereby eliminate the risk of such hotspots to occur, a "flow homogenizer" 8 is positioned in the reactor at a location between the nozzle 7 and the catalyst 4. The homogenizer 8 extends across the entire chamber in the transverse/radial direction. Suitably the homogenizer is a mesh, or a perforated plate. When the turbulent flow hits the homogenizer the flow is broken up in much smaller flows that will cause a thorough mixing and thus level out any concentration differences in the mixture.

Now the novel mixing feature will be described with reference to FIG. 2.

It comprises baffle like elements 24 arranged concentrically around the nozzle 7 at a location between the nozzle and the periphery of the distributor plate 20. These baffles 24 are made by punching or cutting out portions in the distributor plate 20 corresponding to circular segments, leaving one portion of the segments attached or integral with the plate 20. This creates foldable "flaps" that can be bent upwards such they project at an angle from the plane of the distributor plate 20. In FIG. 2 this is indicated with broken lines 25. Preferably an inner part of each segment is shorter than an outer part, such that the bending lines 25 do not extend radially, but rather at an angle with respect to a radius. Thus as can be seen in FIG. 2, air entering from the back side will impinge on the flaps 24 and will thereby be redirected sideways so as to create a spiral flow. In the illustrated embodiment there are six flaps, but the number is not critical and could vary depending on reactor size and geometry.

There are numerous possible configurations of means for redirecting the air flow and apart from the one described one could envisage making the apertures themselves such that the bore forms an angle. However, the particular design of a distributor for mixing is dependent on the manner in which air is supplied, and will be a matter of construction without need for inventive work and pertaining to the field of the skilled man.

The other important feature of the invention is the provision of the homogenizer, briefly mentioned above.

FIG. 3*a* shows one example of a homogenizer 30 implemented in an embodiment of the present invention. It comprises a partition member in the form of a wall dividing the reactor chamber in two compartments, a first compartment wherein the mixing takes place, and a second compartment downstream of the first compartment wherein the flow is "linearized", i.e. homogenized to exhibit essentially linear flow of the gases.

In a first embodiment shown in FIG. 3*a*, the homogenizer 8 has a plurality of openings 32 of different sizes. In the shown embodiment two sizes are shown, but three or four even more sizes can be used. In the centre of the homogenizer 30 there are no openings, and thus an area 31 is provided that functions as a flame shield 8' to prevent the flame (7" in FIG. 1) to enter into the second compartment, where it might cause damage to the catalyst 4.

The function of the openings 32 is to break up the turbulent rotational flow in the first mixing compartment when the flow impinges on the homogenizer 8. Obviously at least some of the flowing gas will pass through the openings 32 whereas some will be reflected by the wall sections between the openings 32. The result will eventually be a much more forward directed momentum in the flowing gas, and in the second compartment an essentially linear flow will be created. In this way variations in heat content in the gas flow will be levelled out in the second compartment and the before mentioned hotspots are much more unlikely to occur.

FIG. 3*b* illustrates schematically another embodiment of a homogenizer that can be implemented in the present invention. It comprises a mesh 34 (only partially shown; it covers the entire circular cross-section of a reactor) made of fairly thick bars 36 arranged preferably perpendicularly so as to form square openings 38. These openings 38 will function essentially in the same way as the opening in the previous embodiment in FIG. 3*a*.

In preferred embodiments the entire reactor is cooled by cooling water. By making the housing for the reactor double-walled, cooling water can be passed through the circumferential compartment (at 5 in FIG. 1) inside the double-walled housing. The water is preferably passed through the cooling system in counterflow, as can be seen in FIG. 1 wherein water W is entering via an inlet $\mathbf{12}_{in}$ in the distal end and leaving at the proximal end via an outlet $\mathbf{12}_{out}$.

The invention claimed is:

1. A catalytic burner, comprising a generally cylindrical reactor chamber (1) comprising a housing (1') having a proximal end (1*p*) and a distal end (1*d*);

a catalyst (4) provided in the distal end of the reactor chamber (1);

a plurality of air inlets (24*a*, 24*b*) arranged in the reactor wall at the proximal end, and configured to provide a rotating flow of the air injected into the reactor chamber by the provision of mixing means (6*a*) arranged around the air inlets;

a fuel inlet (7) provided in the proximal end of the reactor chamber, arranged to inject the fuel into the rotating air flow;

a flow homogenizer (8; 30) extending over the cross-section of the reactor chamber at a position between the fuel inlet (7) and the catalyst (4), and comprising a partition member in the form of a wall dividing the reactor chamber in two compartments, a first compartment wherein the mixing takes place, and a second compartment downstream of the first compartment wherein the flow is homogenized to exhibit essentially linear flow of the gases.

2. The burner as claimed in claim 1, wherein the fuel inlet comprises a fuel atomizing nozzle (7').

3. The burner as claimed in claim 1, wherein the air inlets comprise apertures (24*a*) partly covered by flaps (24*b*) arranged to redirect the air flow in an essentially tangential direction so as to cause said rotation.

4. The burner as claimed in claim 1, wherein the flow homogenizer comprises a perforated partition member (30, 32; 36, 38).

5. The burner as claimed in claim 4, wherein the flow homogenizer is a mesh (36, 38).

6. The burner as claimed in claim 4, wherein the flow homogenizer (8; 30) comprises a central part (31) that is not perforated.

7. The burner as claimed in claim 1, wherein the housing is doubled-walled (5', 5") to provide a cooling jacket (12).

8. The burner as claimed in claim 7, having a distal water inlet ($\mathbf{12}_{in}$) and a proximal water outlet ($\mathbf{12}_{out}$) to and from the cooling jacket (12), respectively.

9. The burner as claimed in claim 3, wherein the flaps form an angle with respect to the reactor wall of 15-60°.

10. The burner as claimed in claim 2, wherein the flow homogenizer comprises a perforated partition member (30, 32; 36, 38).

11. The burner as claimed in claim 3, wherein the flow homogenizer comprises a perforated partition member (30, 32; 36, 38).

12. The burner as claimed in claim 5, wherein the flow homogenizer (8; 30) comprises a central part (31) that is not perforated.

13. The burner of claim 1, wherein, the fuel inlet and air inlets are separate so that the fuel and the air are introduced separately in the reactor and then mix to form a homogeneous mixture before contact is made with the catalyst and before combustion occurs, wherein the fuel inlet comprises a fuel atomizing nozzle (7'), the flow homogenizer (8; 30) extends over an entirety of the reactor chamber at the cross-section of the reactor chamber at a position between the nozzle (7') and the catalyst (4), and in the second compartment downstream of the first compartment, the flow is homogenized to exhibit linear flow of the gases.

14. The burner of claim 1, wherein, the fuel inlet and air inlets are separate so that the fuel and the air are introduced separately in the reactor and then mix to form a homogeneous mixture before contact is made with the catalyst and before combustion occurs, wherein the fuel inlet comprises a fuel atomizing nozzle (7'), the flow homogenizer (8; 30) extends over the cross-section of the reactor chamber at a position between the nozzle (7') and the catalyst (4), and in the second compartment downstream of the first compartment, the flow is homogenized to exhibit linear flow of the gases.

15. The burner of claim 13, wherein, the partition member is comprised of a plurality of openings (32) of at least three different sizes, the openings breaking up turbulent rotational flow, with a center of the partition member including a flame shield (8', 31) free of any openings.

16. The burner of claim 14, wherein, the partition member is comprised of a plurality of openings (32) of at least three different sizes, the openings breaking up turbulent rotational flow, with a center of the partition member including a flame shield (8', 31) free of any openings.

17. The burner of claim 13, wherein, the partition member is comprised of a mesh (34) covering the cross-section of the reactor chamber, the mesh providing square openings (38), the square openings breaking up turbulent rotational flow, with a center of the partition member including a flame shield (8', 31) free of any openings.

18. The burner of claim 14, wherein, the partition member is comprised of a mesh (34) covering the cross-section of the reactor chamber, the mesh providing square openings (38), the square openings breaking up turbulent rotational flow, with a center of the partition member including a flame shield (8', 31) free of any openings.

19. The burner of claim 14, wherein, the proximal end (1*p*) of the reactor chamber (1) is comprised of a distributor plate (20) with the fuel inlet being a fuel atomizing nozzle (7) centrally located within the distributor plate, and the air inlets being arranged concentrically around the nozzle at a periphery of the distributor plate, the air inlets including circular baffles (24) within the distributor plate that provide rotating flow of the air into the first compartment.

20. The burner of claim 1, wherein, the proximal end (1*p*) of reactor chamber (1) is comprised of a distributor plate (20) with the fuel inlet being a fuel atomizing nozzle (7) centrally located within the distributor plate, and the air inlets being arranged concentrically around the nozzle, the air inlets including circular baffles (24) within the distributor plate that provide rotating flow of the air into the first compartment, and, the partition member is comprised of a plurality of openings (32), the openings breaking up turbulent rotational flow, with a center of the partition member including a flame shield (8', 31) free of any openings, the flame shield (8', 31) being aligned with the fuel atomizing nozzle (7).

* * * * *